United States Patent [19]

Tidström

[11] 3,994,202

[45] Nov. 30, 1976

[54] TANK TURRET COVER

[75] Inventor: Bror Erling Tidström, Karlskoga, Sweden

[73] Assignee: AB Bofors, Bofors, Sweden

[22] Filed: Sept. 23, 1975

[21] Appl. No.: 616,093

[30] Foreign Application Priority Data

Oct. 18, 1974 Sweden ..... 7413127

[52] U.S. Cl. ..... 89/36 L; 89/33 F

[51] Int. Cl.² ..... F41H 7/02

[58] Field of Search ..... 89/33 F, 36 H, 36 K, 89/36 L, 40 B, 45

[56] References Cited

UNITED STATES PATENTS 2,976,769 3/1961 Horn ..... 89/36 L

*Primary Examiner*—Stephen C. Bentley

*Attorney, Agent, or Firm*—Pollock, Vande Sande & Priddy

[57] ABSTRACT

A tank having a firearm mounted thereon for selective elevation and depression about trunnions located within a turret, is provided with a cover pivotally mounted on said turret and adapted to be engaged by the recoil jacket of the gun when the gun barrel is in a depressed position to swing the cover upwardly thereby to cause the recoil space to extend at least partially above a frame for the cover. The arrangement further includes a cartridge case deflector located within the tank below the cover and pivotally fastened at its opposing ends to a portion of the cover and to the recoil jacket of the barrel respectively, and the sides of the cartridge case deflector are adapted to be compressed by one another when engaged by a loading tray within the turret to enable rounds to be moved from a magazine to a loading position.

6 Claims, 10 Drawing Figures

TANK TURRET COVER

The present invention relates to a device with a cover that can be swung up on a tank which has a barrel supported at a distance from its breech ring, the cover then being located above the breech ring and a recoil space for same and being designed so that when the barrel is in a depressed position in relation to the chassis it will move into a swung-up position and thereby permit the recoil space to extend at least partly above the frame for the cover and so that when it is in the swung-up position it will be sealed against the frame for the cover by means of side and rear parts directed downwards.

In a tank with a cover of said kind it is possible to give the tank a low silhouette which makes it difficult for an enemy to hit, at the same time as a relatively large angle of depression can be maintained in the entire field of traverse of the barrel of the tank.

In a tank with a cover of this type, however, there are problems involved in obtaining suitable cartridge case deflection in cases when this is to take place automatically and via an opening at the rear parts of the tank. The present invention is directed towards these problems, and comprises a proposal that the cover should be arranged in a special way to a special cartridge case deflector. The feature that can mainly be considered to be characteristic for a device according to the invention is then that it also comprises a cartridge case deflector which, in a plane at right angles to the trunnions of the barrel, has one end rotatably fastened to the cover and its other end fastened to the recoil jacket of the barrel or correspondingly in order to achieve a deflection channel which in the cartridge case ejection position of the barrel extends from the breech ring of the barrel to an opening arranged in the rear part of the cover which is directed downwards, irrespective of the elevation or depression of the barrel and of the position of the cover.

Figure 1:
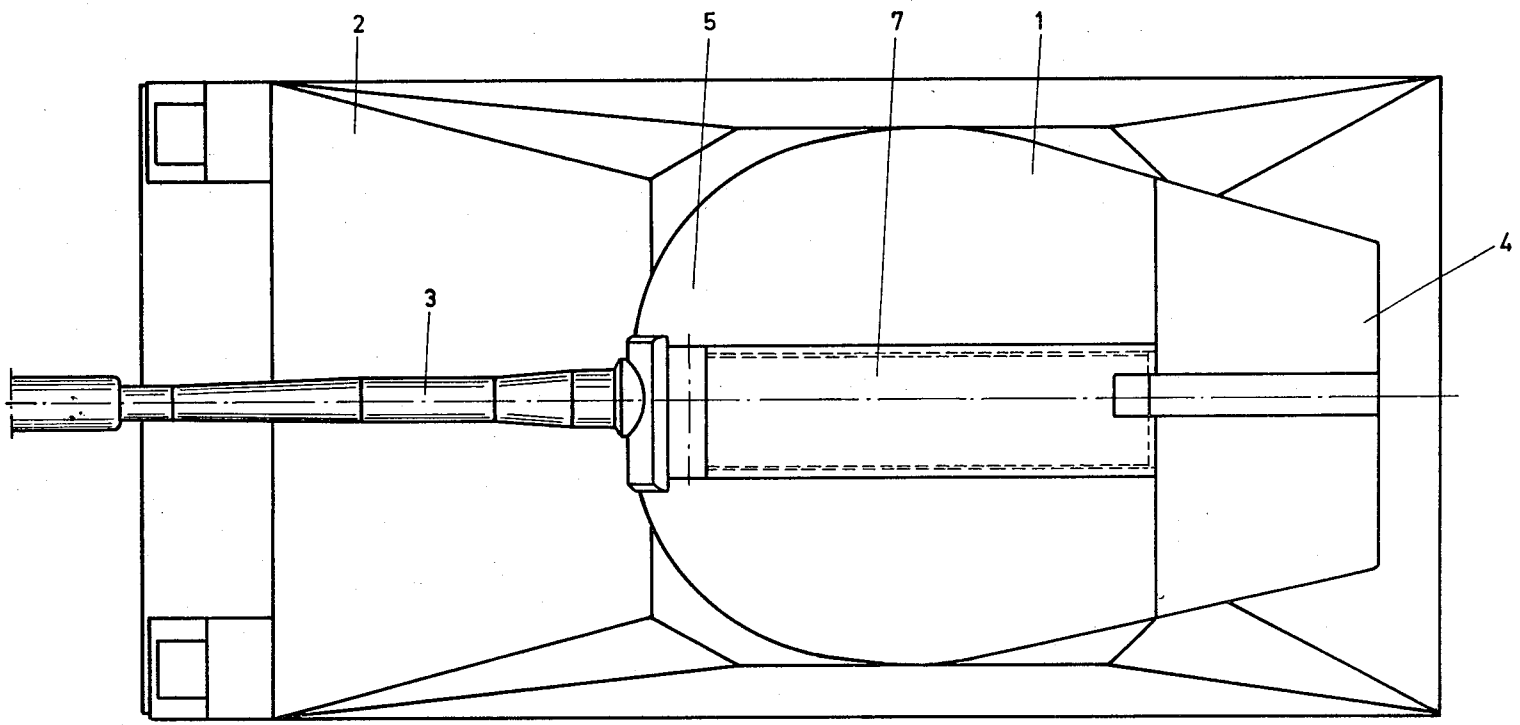
Figure 2:
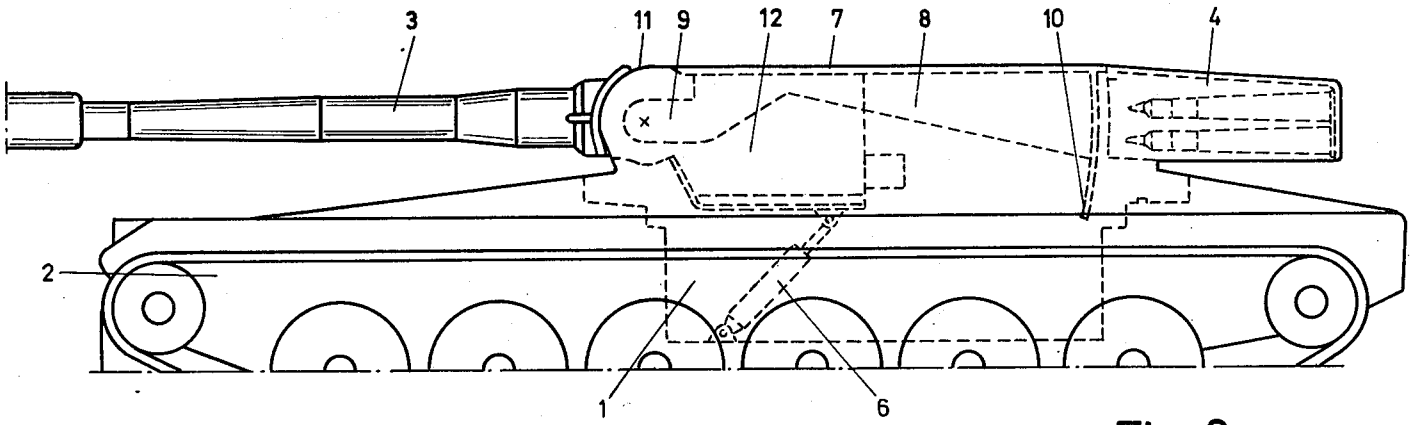
Figure 3:
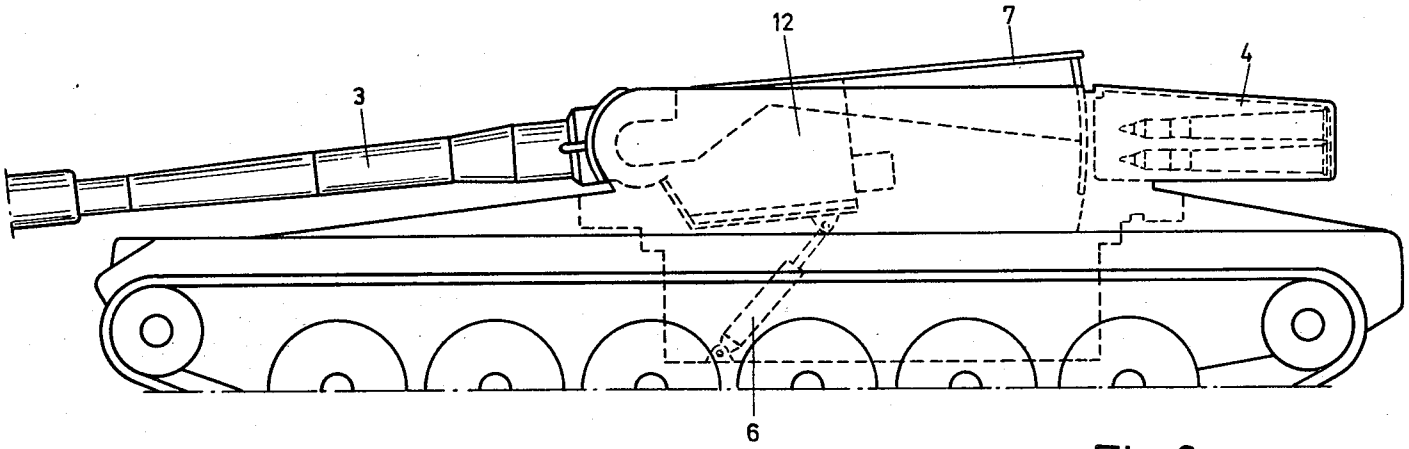

An embodiment proposed at present of a device which has the specific features characteristic for the invention will be described in the following, with reference to the accompanying drawings, in which FIG. 1 in a horizontal view shows a tank utilizing the invention in a first embodiment, FIGS. 2-3 in vertical views from the side show the tank according to FIG. 1 with the barrel in different vertical positions, FIG. 4 in a vertical view and partly from the rear shows the tank according to FIGS. 1-3, FIG. 5 in a vertical view and partly in cross-section show parts comprised in the tank according to FIGS. 1-4, FIGS. 6-7 in various functioning positions show the principle of a cartridge case deflector shown in FIG. 5 and FIGS. 8a-8c in perspective and end views show the principle of the cartridge case deflector and its fastening to the cover.

In the figures, parts corresponding to each other have been given the same reference designations. In FIGS. 1-3, the rotatable turret of a turret tank has been designated 1, the actual tank has been designated 2, and the barrel of a large-calibre firearm in the form of a 105 mm high-pressure gun has beend designated 3. The tank also comprises a magazine 4, which is fastened to the turret 1 so that it follows the movements of the turret. The turret 1 is set down in the tank body, and the barrel 3 is supported at the front parts of the turret with trunnions 5 in a way which is known in itself, so that the barrel can be elevated and depressed in relation to the turret. Also the elevation takes place in a way which is known in itself with the aid of a hydraulic cylinder 6. On its upper side, the magazine 4 is provided with an external trough which is used for the ejection of empty cartridge cases.

In accordance with the invention, above the breech ring of the barrel 3 and a recoil space for this, a cover 7 is arranged in the roof of the turret 1 along the entire longitudinal extent of the turret from the front edge of the turret at the barrel 3 to the magazine 4 at the rear edge of the turret. The cover 7 has a rectangular horizontal section as shown in FIG. 1, and is moreover set down in the roof of the turret so that, in its closed position, it is aligned with the outer contour of the roof of the turret.

On its longitudidnal sides, the cover 7 is provided with side parts 8, directed downwards, which at the front end of the cover are made with sections 9, directed forwards, which via the cover are supported in the trunnion 5 for the barrel 3. The cover 7 is also made with a rear edge 10, directed downwards. The flat upper part of the cover extends past the downwardly directed parts 8, 10 on all sides, and the protruding parts of said upper part of the cover, at the longitudinal sides and at the rear end of the cover, coact with a recessed strip or frame, against which the parts 8, 10 close with sufficient sealing. At the front end, the cover has the necessary sealing with a surface 11 which is rounded in one main direction and straight in the other main direction at the trunnion 5. Starting from a place in the vicinity of the middle of the cover, the side parts 8 have a successively increasing height towards their opposite ends. The width of the cover 7 exceeds the width of the breech ring somewhat. The recoil jacket 12 of the firearm can coact with the lower surface of the flat upper part of the cover so that at an elevation of 0° there will be coaction. If, thereafter, the barrel 3 is depressed in relation to the turret 1, the recoil jacket 12 will push up the cover to an extent corresponding to the angle of depression. At the maximum depression (−10°) in accordance with figure 3 the cover 7 will thus be in its most swung-up position, and the actuation between 0° and −10° is continuously variable in the example of the embodiment. Through the swinging up of the cover 7, the recoil space for the breech ring can extend partly above the roof of the turret. The cover falls down of its own weight when the actuation from the recoil jacket 12 ceases.

Figure 4:
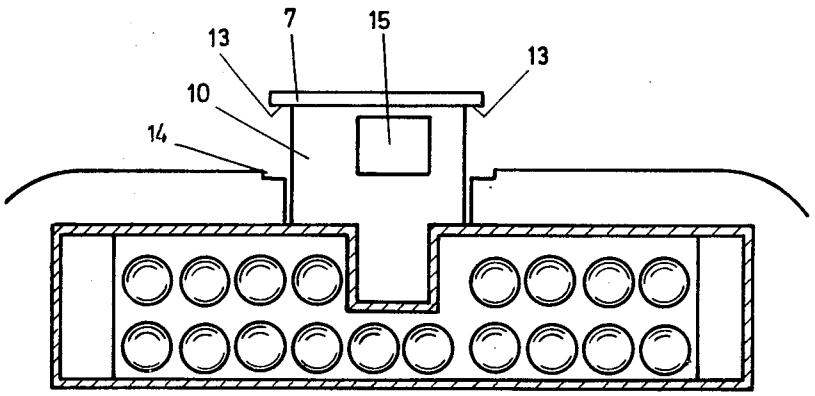

In figure 4, the portions of the upper part of the cover which extend past the downwardly directed side parts thereof are designated 13, while the recessed strip has the designation 14. The rear part 10 of the cover is provided with an opening 15, via which ejection of empty cartridge cases takes place. The opening 15 can be closed from inside, by means of a cover not shown in detail.

Figure 5:
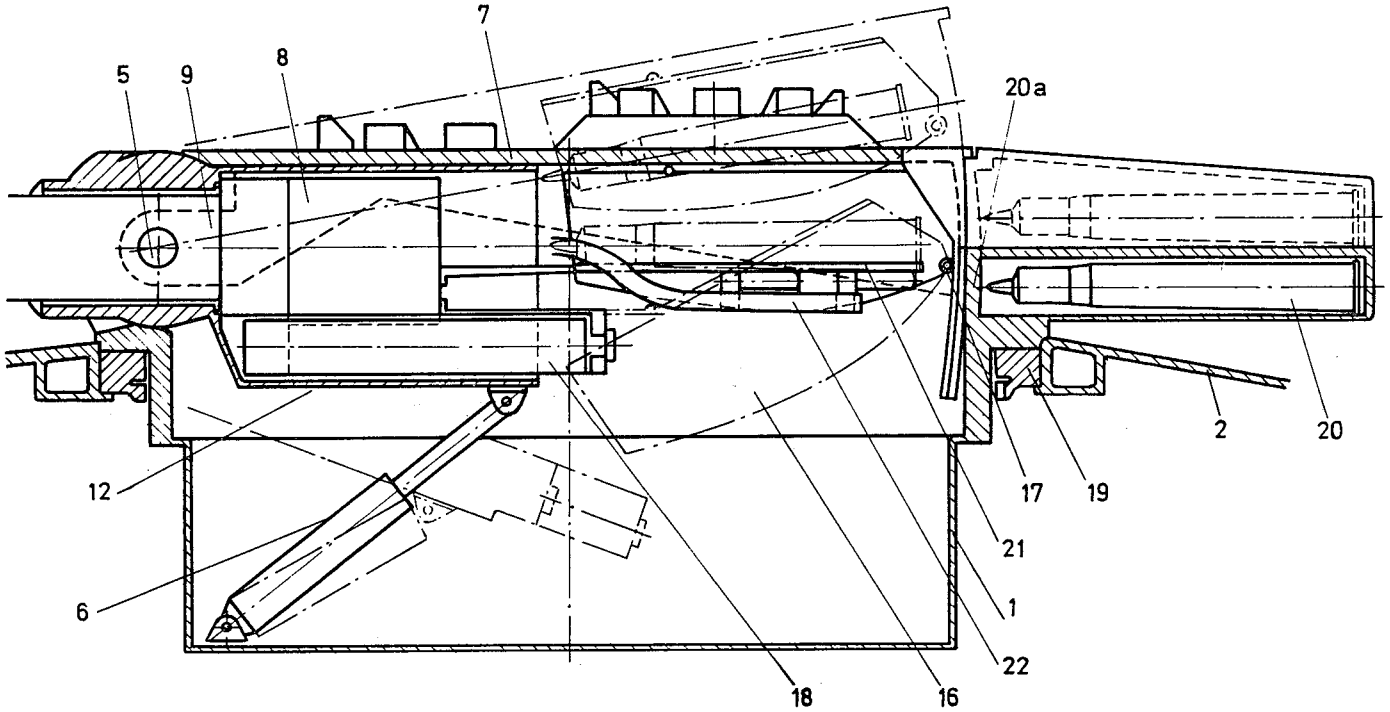

FIG. 5 is intended, inter alia, to illustrate the positioning according to the design in relation to the cover of the cartridge case deflector shown in FIG. 8 a, which in FIG. 5 has been given the designation 16, and is shown in three different functioning positions. In a plane at right angles to the trunnions 5 of the barrel, one of the sides of the cartridge case deflector 16 is rotatably fastened to the cover 7 at a support 17, and is also fastened to the recoil jacket 12 in a way not shown in detail in FIG. 5. Further, the contact of the upper side of the recoil jacket 12 against the inner surface of the cover 7 at elevation 0° is shown in detail. The cylinder 6 is fastened to the floor of the turret 1 and in the under side of the recoil jacket. The turret 1 is rotatably supported on a ring 19.

FIG. 5 also shows in detail how rounds 20 are placed in two layers in the magazine 4, which is separated from the crew compartment by a heavy armour wall 20a, which is provided with an opening that can be closed, via which the rounds, one at a time, can be inserted into the crew compartment onto a loading tray 21 which is fastened to a pendulum arm 22. Said pendulum arm 22 is supported in the trunnion 5 of the gun barrel, and the loading tray 21 is arranged on the pendulum arm 22 so that the end of the loading tray, irrespective of the angle of elevation or depression, can be moved to the opening in the magazine wall, the round, point first, can be pulled in onto the loading tray 21, and thereafter the loading tray can be set in a position along the extension of the center line of the barrel so that ramming can take place in a way which is known in itself.

Figure 6:
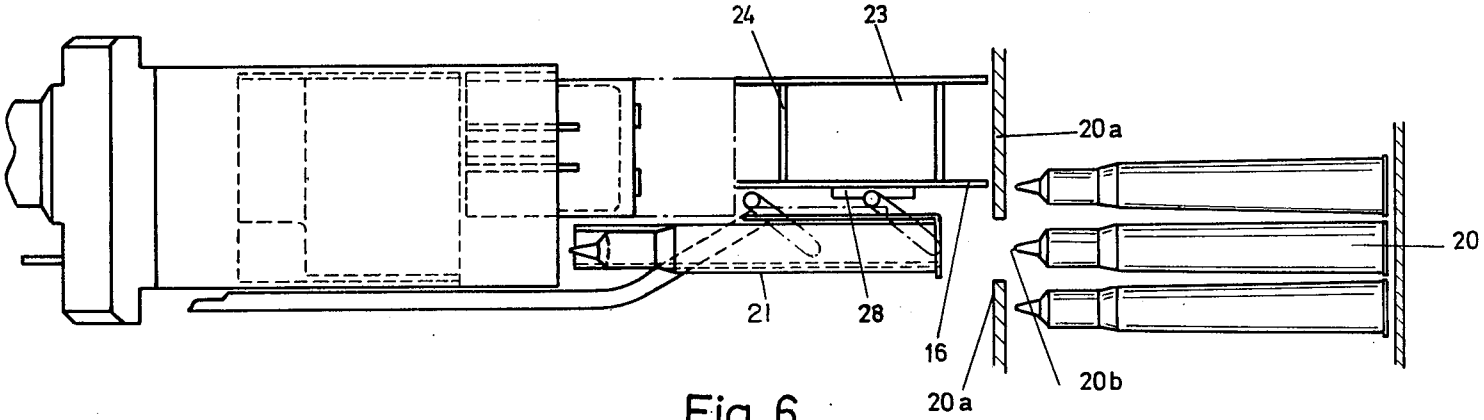
Figure 7:
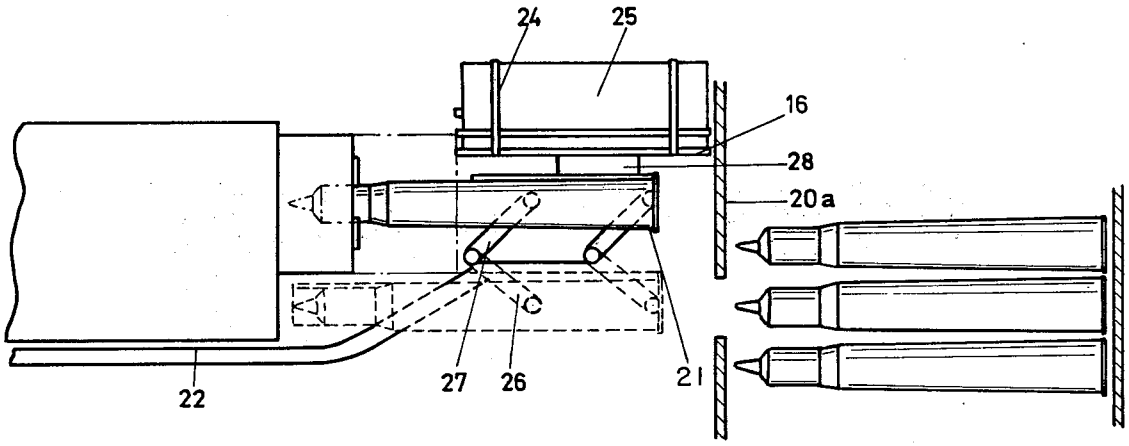

FIGS. 6 and 7 are intended to illustrate the principle of the cartridge case deflection and the pendulum arm 22 and the loading tray 21 in more detail. In addition to the wall 16, the cartridge case deflector also comprises a wall 23 and guide pins 24. The bottom 25 of the cartridge case deflector is guided in a longitudinal opening in the wall 23 (see FIG. 8), so that the wall 16 will be arranged so that it can be displaced inwards and outwards in relation to the wall 23, without any risk for jamming. The displacement of the wall 16 takes place by means of the loading tray 21, which is supported on arms 26 and 27, so that the tray can be displaced laterally in relation to the pendulum arm 22.

FIG. 6 shows the position where the loading tray 21 is arranged above the opening 20b in the magazine wall 20a so that a round 20 can be transferred from the magazine 4 via the opening 20b to the loading tray 21. FIG. 7 shows how the loading tray 21 can be displaced in the lateral position to the ramming position for the round. The displacement of the side wall 16 on the cartridge case deflector takes place via a member 28 which transmits the force from the loading tray. At the return of the loading tray to the feeding position in front of the opening 20b, the side wall 16 resumes its original position according to FIG. 6, with the aid of springs described in the following at the wall guides.

The extraction of the round from the magazine to the loading tray can take place by means of gripping members which can be actuated with a manual lever. The movement of the loading tray laterally and the swinging up of the pendulum arm to the ramming position can take place through direct manual actuation.

Figures 8A, 8B, 8C:
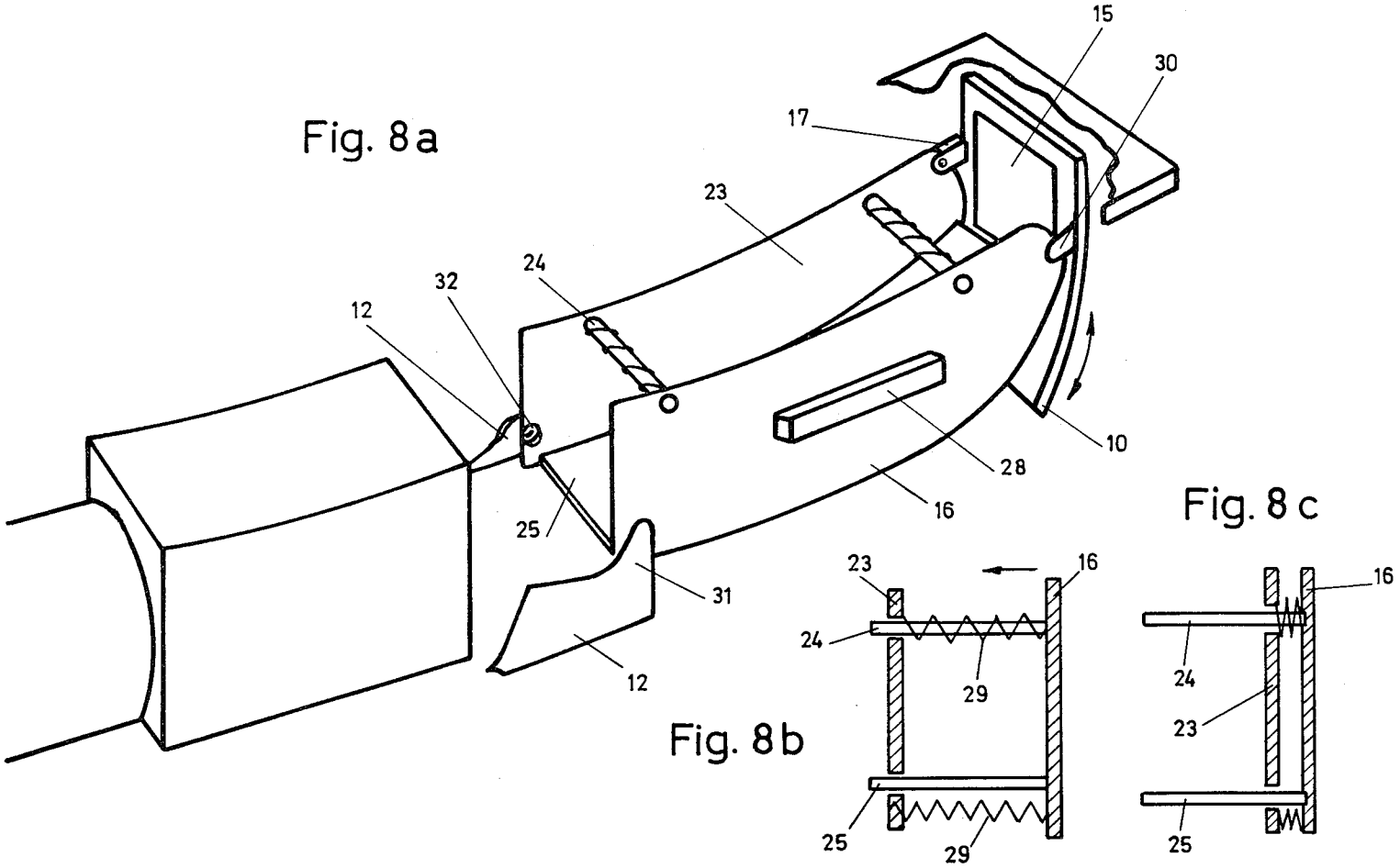

FIGS. 8a-8c show the principle of the mode of operation of the cartridge case deflector. For the return of the wall 16, the cartridge case deflector has springs 29 arranged at the guide pins 24 and under the bottom 25 of the cartridge case deflector. The springs are compressed when the walls 16, 23 are pressed together, and return the wall 16 as soon as the actuation from the loading tray 21 ceases. The wall 23 is rotatably fastened at the bracket 17 in the cover rear edge 10, which is also provided with a stop 30 which limits the spring return of the wall 16 at the cover. The recoil jacket 12 has a corresponding stop 31. At its other end, the wall 23 is rotatably supported 12 at the recoil jacket in a support 32. Said supports 17 and 23 are made so that turning can take place in a plane at right angles to the trunnions 5 of the barrel.

The invention is not limited to the embodiments shown above as examples, but can be subject to modifications within the scope of the following claims. Thus, the tank chassis can be arranged so that it can be depressed in a way which is known in itself by means of special depression cylinders.

I claim:

1. In combination, a tank, a firearm having a barrel mounted on said tank for selective elevation and depression about trunnions located on said tank, said firearm including a breech ring and a recoil jacket within said tank, a cover mounted on a frame on said tank, said cover being positioned above said breech ring and above a recoil space for said recoil jacket, said cover being mounted in said frame for pivotal movement so that, when the barrel of said firearm is in a depressed position in relation to the chassis of said tank, said cover is engaged by a portion of said firearm rearward of said trunnions to cause said cover to move into a swung-up position thereby to cause said recoil space to extend at least partly above said frame, said cover including downwardly extending portions operative, when said cover is in said swung-up position, to seal said cover against said frame, and a cartridge case deflector located within said tank below said cover, said deflector, in a plane at right angles to said trunnions, having one end thereof rotatably fastened to said cover and its other end rotatably fastened adjacent said recoil jacket, said deflector being operative to provide a deflection channel which, in the cartridge case, ejection position of the barrel, extends from the breech ring of the barrel to an opening arranged in the rear part of said cover irrespective of the elevation or depression of said barrel and of the position of said cover.

2. The structure of claim 1 wherein said tank includes a rotatable turret, said cover comprising a portion of said turret.

3. The structure of claim 1 wherein said cartridge case deflector comprises two side walls and bottom therebetween, said side walls being mounted for selective movement toward one another thereby to permit said deflector to be compressed in the direction of its width to make it possible to move rounds to a loading position relative to said firearm.

4. The structure of claim 3 wherein the bottom of said deflector is rigidly fastened to one of said side walls, said bottom being supported in a slot provided in the other side wall so that it can be pressed inwards and outwards relative to said slot in said other side wall, each of said rotatable fastenings being made in said other side wall.

5. The structure of claim 4 including a loading tray mounted for movement within said tank, said tray being positioned alongside said cartridge case deflector and being operative to engage a sidewall of said deflector to compress said deflector when said loading tray is in a loading position.

6. The structure of claim 5 including guide pins extending between the upper parts of said side walls in spaced relation to said bottom, spring means disposed adjacent said guide pins and adjacent said bottom and arranged so that, as soon as the force pressing the side walls together ceases, said spring means return the side walls to a spaced apart position relative to one another, and stops located on said cover and on said recoil jacket for limiting the movement of said sidewalls away from one another.

* * * * *